US009382031B2

(12) United States Patent
Ward, Jr.

(10) Patent No.: US 9,382,031 B2
(45) Date of Patent: Jul. 5, 2016

(54) WRAPAROUND-STYLE CONTAINER WITH RECLOSABLE FEATURE

(71) Applicant: INTERNATIONAL PAPER COMPANY, Memphis, TN (US)

(72) Inventor: James A. Ward, Jr., Plano, IL (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 14/833,589

(22) Filed: Aug. 24, 2015

(65) Prior Publication Data

US 2016/0052664 A1 Feb. 25, 2016

Related U.S. Application Data

(60) Provisional application No. 62/041,292, filed on Aug. 25, 2014.

(51) Int. Cl.
*B65D 5/18* (2006.01)
*B65D 5/54* (2006.01)

(52) U.S. Cl.
CPC *B65D 5/18* (2013.01); *B65D 5/546* (2013.01); *B65D 5/548* (2013.01)

(58) Field of Classification Search
CPC ..... B65D 5/18; B65D 5/0227; B65D 5/22; B65D 5/28
USPC ..... 229/141, 142, 143, 136, 159, 147, 172, 229/198; 206/736
See application file for complete search history.

(56) References Cited

U.S. PATENT DOCUMENTS

| | | | | |
|---|---|---|---|---|
| 2,596,224 | A * | 5/1952 | Eaton | B65D 5/0227 229/132 |
| 3,112,058 | A * | 11/1963 | Martin | B65D 5/22 206/445 |
| 4,271,964 | A | 6/1981 | Train | |
| 4,369,914 | A * | 1/1983 | Langston, Jr. | B65D 5/6626 229/159 |
| 6,974,033 | B2 | 12/2005 | McLeod et al. | |
| 7,669,755 | B2 * | 3/2010 | Smalley | B65D 71/36 229/145 |

FOREIGN PATENT DOCUMENTS

| | | |
|---|---|---|
| EP | 0455610 | 11/1991 |
| FR | 286630 | 8/2005 |
| JP | S6265919 | 4/1987 |
| JP | 2005082189 | 3/2005 |

* cited by examiner

*Primary Examiner* — Christopher Demeree
(74) *Attorney, Agent, or Firm* — Matthew M. Eslami

(57) ABSTRACT

A wraparound-style shipping and reclosable container is formed from a one-piece corrugated paperboard blank. The container comprises a bottom wall foldably joined to respective upstanding first and second opposed side walls. Each of the respective first and second opposed side walls includes a respective pair of end walls which are foldably joined to respective lateral edges thereof. A top cover is foldably joined to the longitudinal edge of the first side wall to enclose container. The top cover includes two tuck flaps each of which is foldably joined to the respective lateral edges. The container is enabled to be reclosed by tucking a rear portion of the respective tuck flaps toward inside of the interior space of the container and leaving a front portion of the respective wing flaps to the outside of the container.

5 Claims, 6 Drawing Sheets

WRAPAROUND-STYLE CONTAINER WITH RECLOSABLE FEATURE

CROSS REFERENCE TO RELATED APPLICATION

This application claims priority to U.S. provisional patent application Ser. No. 62/041,292, filed on 25 Aug. 2014, which is hereby incorporated hereinto by reference as if fully restated herein.

FIELD OF THE INVENTION

This invention relates generally to wraparound-style for shipping and display products at points of sale. More particularly, the invention is a wraparound-style shipping and reclosable container with a built-in top closure.

BACKGROUND OF THE INVENTION

It is well known to use corrugated shipping containers to package, store, and transport products from manufacturer to the point of sale, such as a retail store. Once the shipping container reaches the retail store, the products are removed from the container and are typically placed on display shelves. One drawback of such containers is that a significant amount of labor is required to remove the articles from the container and, in turn, place them on the display shelves. To reduce packaging costs, combined shipping and display containers have been utilized. The containers used to form the packages have to be strong enough to support and protect the products during shipment and in addition be capable of presenting the products on display. This has resulted in the use of relatively complicated container designs which require somewhat involved set-up procedures, often entailing the reassembly of the shipping container into a display package having a different appearance. Such combination of shipping and display packages are often limited to handling only small numbers of products. The prior art wraparound-style containers have some deficiencies. Most of the wraparound-style containers have a perforated opening feature in the top of the container. The top opening feature tends to break open prematurely during transportation. The top opening feature is used at the retail store such as, grocery and/or liquor stores, to access the product and then place the product on the shelf. After the product is removed from the container, the container is reused as a display container or tray. However, the present top opening feature does not allow this to happen easily. In addition, most current wraparounds either have no perforated opening feature or a perforated feature that once opened, allows access to the product. The non-perforated wraparounds are usually accessed by using a utility knife to open. Cutting the container does not allow the ability to reuse the container if desired.

Accordingly, there is a need for a wraparound-style container capable of being easily opened for access to the product and to enable the container to be reclosed.

SUMMARY OF THE INVENTION

The wraparound-style shipping and reclosable container of the present invention is constructed from one-piece of corrugated paperboard that is easily reclosable by tucking one portion of wing flaps of the top cover to the inside of the container and leaving the second portion of the wing flaps of the cover top to the outside of the container. An efficient and easily machine-formed container is provided from a one-piece paperboard blank. The invention includes various inventive features which may be used singularly or in combination.

Accordingly, one aspect of the present invention is directed to a wraparound-style shipping and reclosable container comprises a bottom wall foldably joined to respective upstanding first and second opposed side walls. A pair of end walls each of which is foldably joined to a respective lateral side of the respective first and second opposed side walls to form an interior space. A top cover is foldably joined to a longitudinal edge of the first side wall to enclose the interior space. A pair of tuck flaps each of which is foldably joined to respective lateral sides of the top cover. Each of the tuck flaps includes a front portion and a rear portion wherein the container is reclosed by tucking the rear portion of the respective tuck flaps to the inside of the interior space and leaving the front portion of the respective tuck flaps to the outside of the interior space.

Another aspect of the present invention is directed to a wraparound-style shipping and reclosable container formed from a one-piece blank. The container comprises a bottom wall foldably joined to respective upstanding first and second opposed side walls. The pair of end walls each of which is foldably joined to a respective lateral side of the respective first and second opposed side walls to form an interior space. It should be noted that a combined widths of the pair of end walls is less than a width of the bottom wall so that a slot is formed therein when the end walls are positioned at right angle on the bottom wall. A top cover is foldably joined to a longitudinal edge of the first side wall to enclose the interior space. The top cover includes two wing panels each of which is defined by a tuck flap and a glue flap that are attached to one another by a frangible line of weakness. The tuck flap includes a front portion and a rear portion which is used to engage with the slot to reclose the container by tucking the rear portion of the respective tuck flaps to the inside of the interior space and leaving the front portion of the respective tuck flaps to the outside of the interior space.

A further aspect of the present invention is directed to a one-piece unitary blank for making a wraparound-style shipping and reclosable container. The blank comprises a bottom wall having two glue panels foldably joined to respective lateral edges thereof and having first and second side wall panels foldably joined to respective longitudinal sides thereof. Each of first and second side wall panels includes a pair of end wall panels each of which is foldably joined thereto in which a combined widths of the pair of end wall panels is less than a width of the bottom wall panel. A top cover panel is foldably joined to a longitudinal edge of the first side wall. The top cover panel includes two wing panels each of which is defined by a tuck flap and a glue flap that are attached to one another by a frangible line of weakness. A shoulder flap is foldably joined to a longitudinal edge of the second wall panel.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
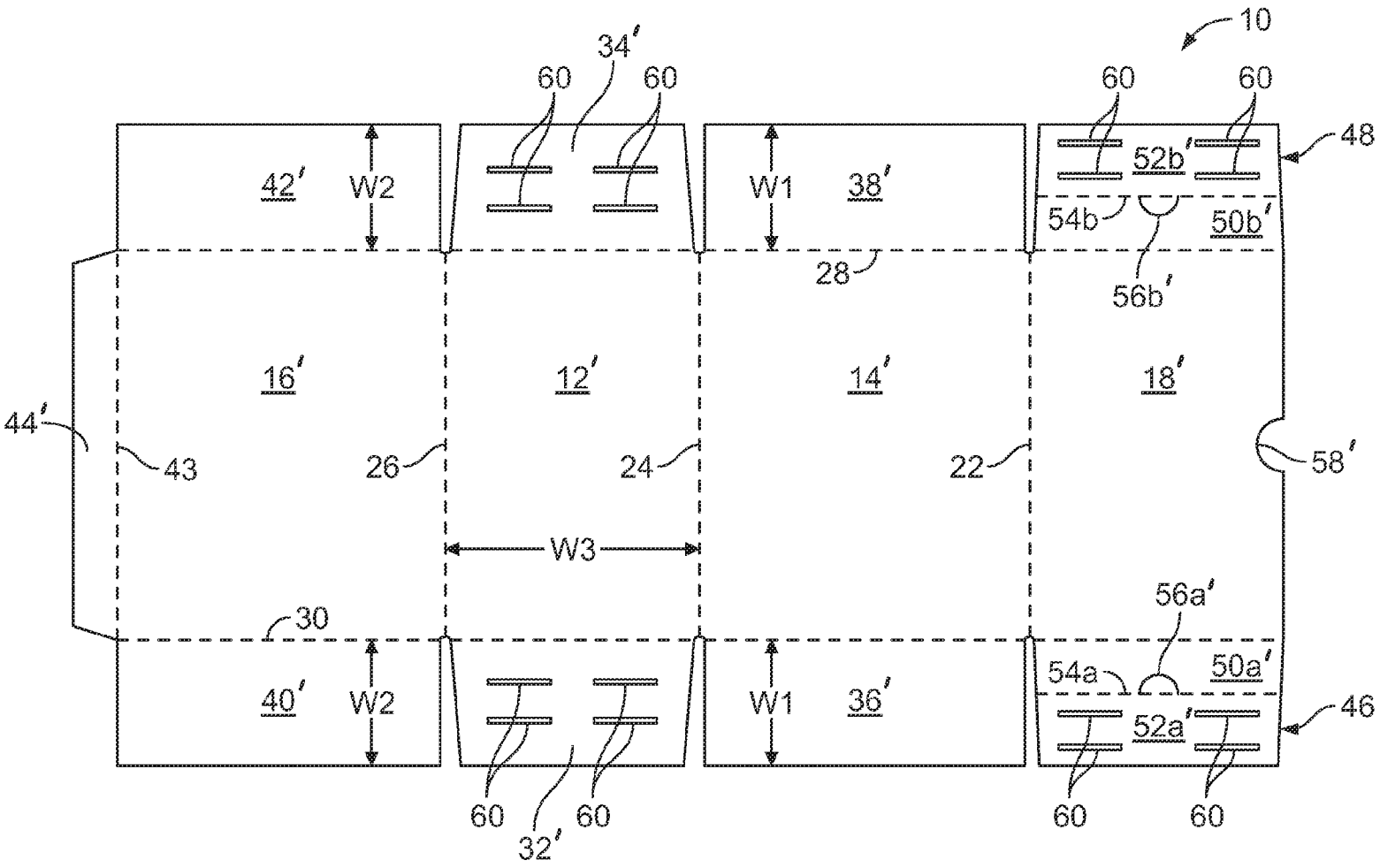
FIG. 1 is a plan view of one-piece corrugated paperboard blank from which a wraparound-style shipping and reclosable container is constructed in accordance with a preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same. In accordance with the usual conventions regarding the illustration of blanks for paperboard or corrugated paperboard articles, and unless otherwise specified, broken or interrupted lines within the boundaries of a blank represent scores, perforations or other lines of weakness, and extended solid lines, on the interior of a blank represent cuts.

FIG. 1 is a plan view of a cut and scored paperboard blank 10 for constructing a wraparound-style shipping and reclosable container 20 in accordance with a preferred embodiment of the invention. The blank 10 is substantially flat symmetrical with respect to its longitudinal axis thereof. The blank 10 is an integral piece of a material such as continuous sheet of conventional corrugated paperboard. The blank 10 is cut along its outer margins to form its specific shape. The blank 10 is divided into a bottom wall panel 12', respective first and second side wall panels 14', 16' and a top cover panel 18' by three transverse parallel fold lines 22, 24, and 26 and two longitudinal parallel fold lines 28, 30 intersecting one another. Two glue panels 32', 34' each of which is foldably joined to respective lateral edges of the bottom wall panel 12' via fold lines 28 and 30. A pair of end wall panels 36', 38' each of which is foldaby joined to the respective lateral edges of the first side wall panel 14' via respective fold lines 28 and 30. Similarly, a pair of end wall panels 40', 42' each of which is foldaby joined to the respective lateral edges of the second side wall panel 16' via respective fold lines 28 and 30. It should be noted that the combined widths (W1+W2) of two end panels 36' and 40' is less than the width (W3) of the bottom wall 12' so that a narrow gap 37*a* (FIGS. 2-6) is formed therein when the respective these end wall panels 36' and 40' are positioned on lateral edge of the bottom wall panel 12' at right angle. Similarly, the combined widths (W1+W2) of two end wall panels 38' and 42' is less than the width (W3) of the bottom wall panel 12' so that a narrow gap 37*b* is formed therein when the widths of these end panels are positioned on lateral edge of the bottom wall panel 12'. A shoulder flap panel 44' is foldably joined to the longitudinal free edge of the second side wall panel 16'. Two wing panels 46', 48' each of which is foldably joined to the respective lateral edges of the top cover panel 18' via respective fold lines 28 and 30. Each of the wing panels 46', 48' is defined by a respective tuck flap and glue flap 50*a*', 52*a*' and respective tuck flap and glue flap 50*b*', 52*b*' via respective frangible lines 54*a*, 54*b*. Each of the respective tuck flaps 50*a*', 50*b*' includes respective finger access holes 56*a*', 56*b*' that are used to separate the respective tuck flaps 50*a*', 50*b*' from the respective glue flaps 52*a*', 52*b*' along the respective frangible lines 54*a*, 54*b* as will be discussed in greater detail hereinafter. A finger access cutout 58' is also formed on the longitudinal free edge of the top cover panel 18'. The glue panels 32' and 34' and the glue flaps 52*a*', 52*b*' are glued to the respective pair of end panels 36', 38' and 40', 42' via glue areas 60 that when the blank 10 is fully folded to form the container 20. Although the blank 10 is characterized as being having side panels and end panels, but one of the ordinary skilled in the art would appreciate that the end panels can be defined as side panels as well and the characterization of the side panels and end panels have no effect on the function or utility of the blank 10.

The manual folding-sequence of the blank 10 is easily accomplished. However, an ordinary skilled in the art would appreciate that generally a folding machine would perform the forming operations. The blank 10 is laid horizontally; the side wall panels 14', 16' are folded upright along respective fold lines 24 and 26 to form the side walls 14, 16 of container 20 as seen best in FIG. 3. Next, the respective end panels 36, 38 and 40, 42 are folded toward one another at right angle so that they rest on respective lateral edges of the bottom wall panel 12'. Next, each of the respective glue panel 32, 34 is folded upright with respect to fold lines 28, 30 and is glued to the respective end panels 36, 38 and 40, 42 using the glue area 60. At this point, products are being placed into the interior space 62 of the container 20. And finally, the top cover panel 18 is used to enclose the interior space 62 of the container 20 when the respective glue flaps 52*a*, 52*b* are glued to the respective end panels 36, 38 and 40, 42 using the glue area 60 as seen best in FIG. 2. It should be noted that the shoulder flap 44 provides a landing surface when the top cover panel 18 is in folded position. The wraparound-style shipping and reclosable container 20 is now transported to the point of sale such as retail or club stores.

Figure 2:
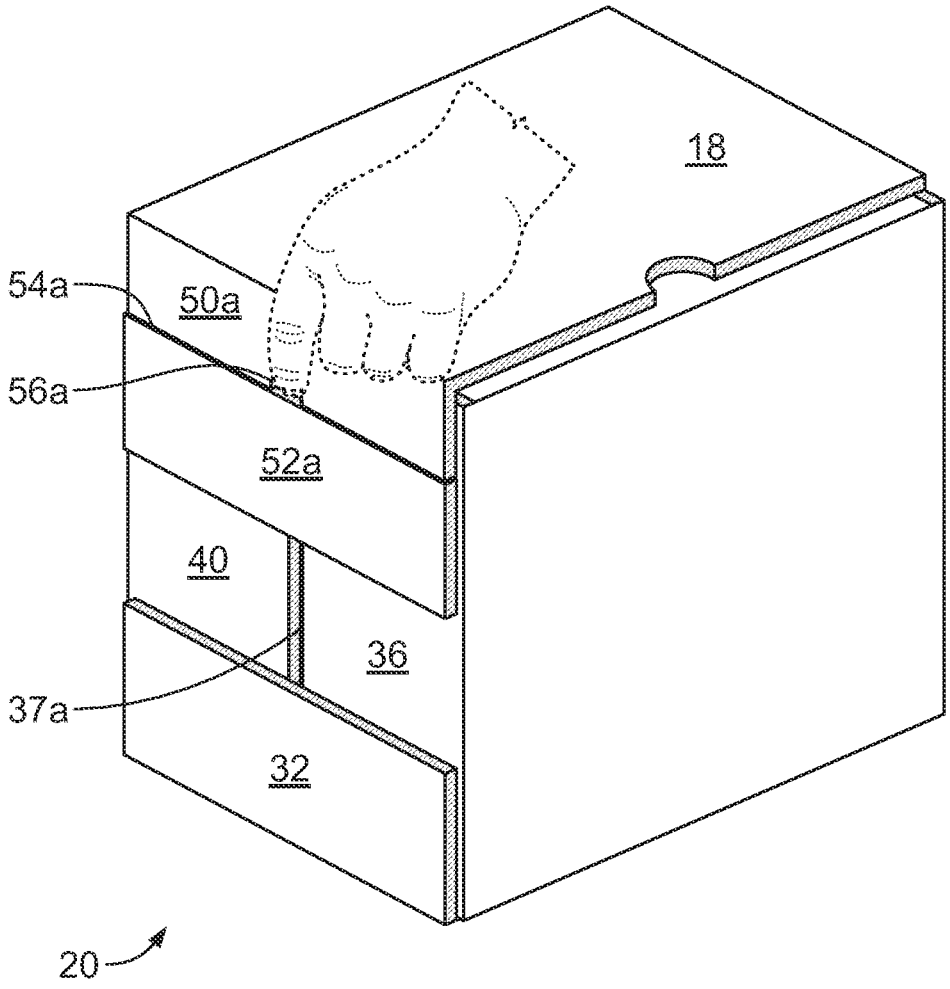
FIG. 2 is a perspective view of the wraparound-style shipping and reclosable container formed from the blank in FIG. 1 shown in an enclosed position and the manner in which the container can be opened.
Figure 3:
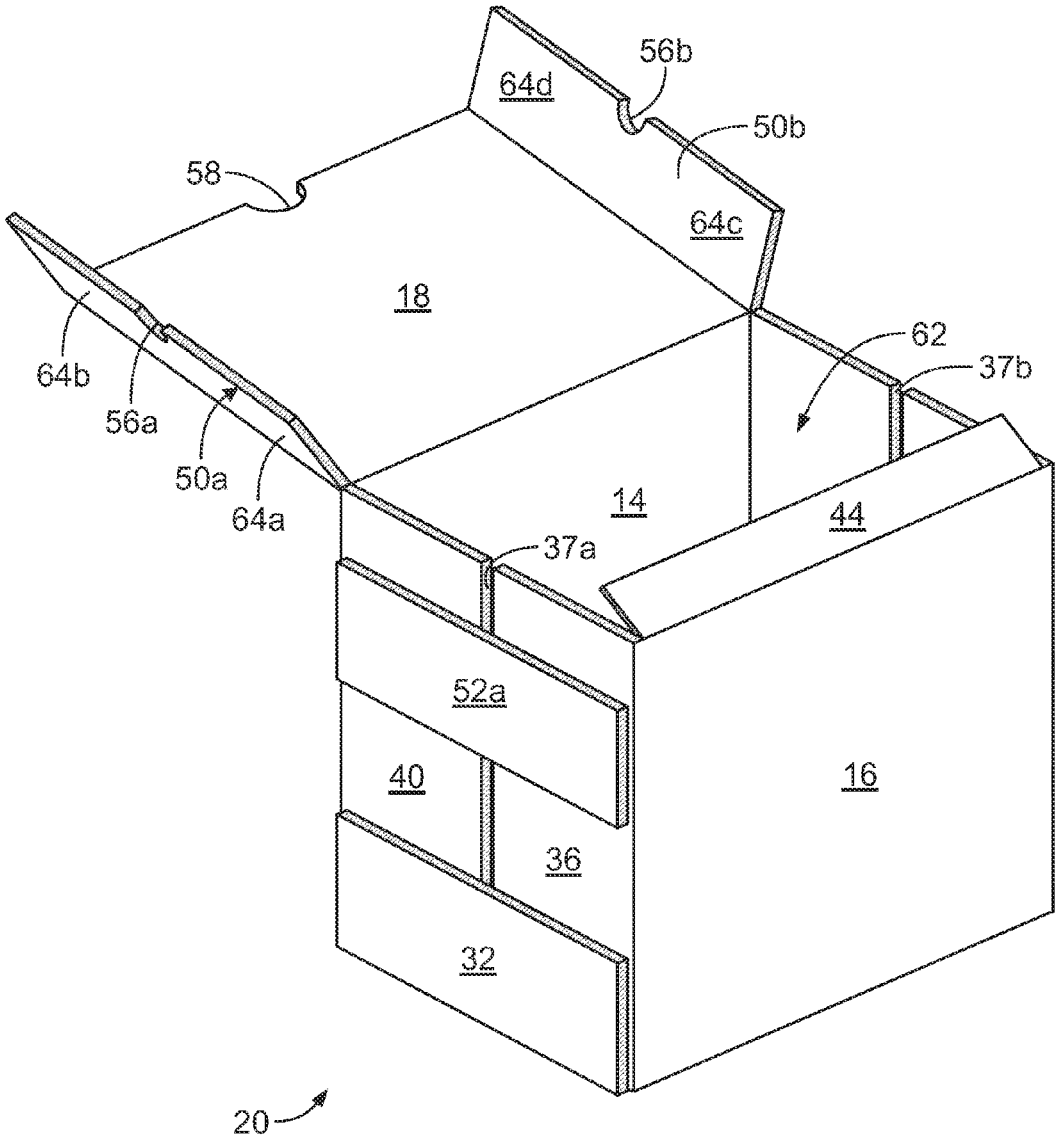
FIG. 3 is a perspective view of the wraparound-style shipping and reclosable container formed from the blank in FIG. 1 shown in a fully open position.
Figure 4:
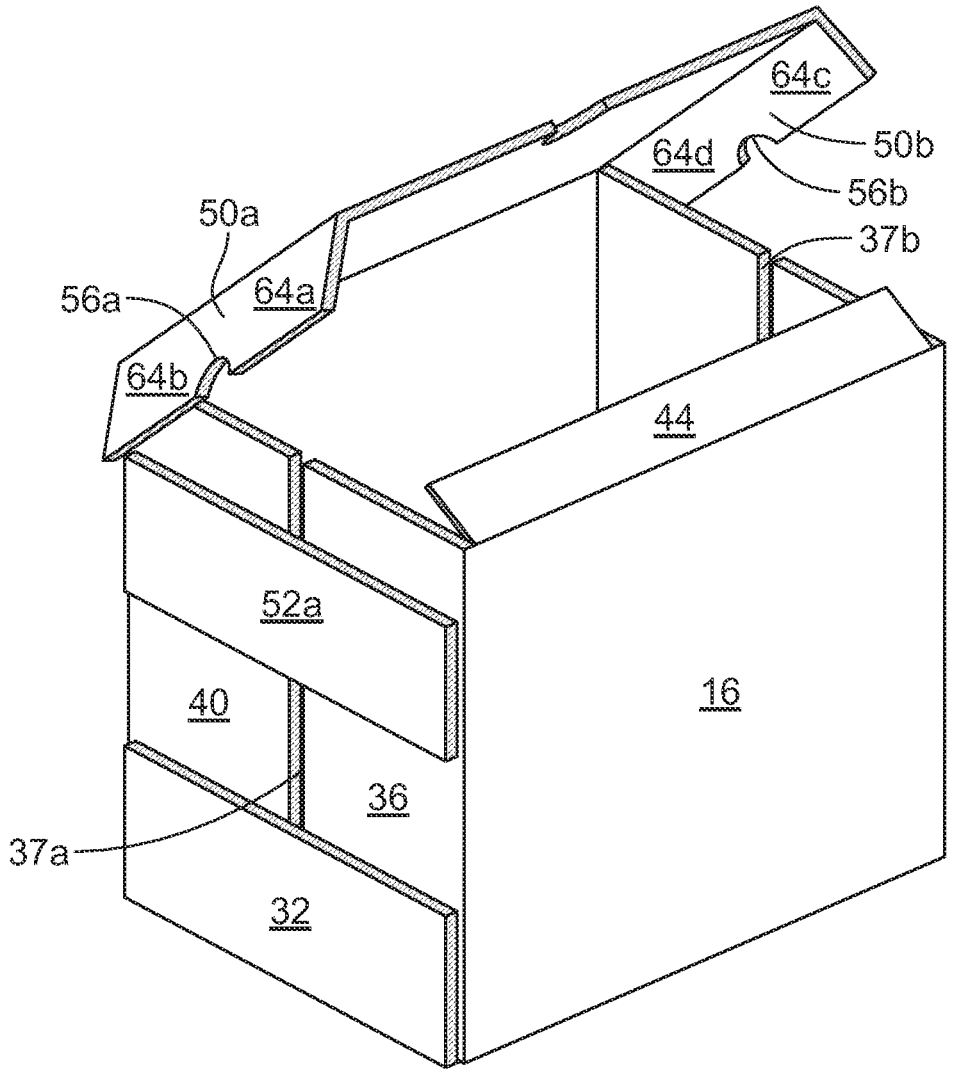
FIGS. 4 and 5 are perspective view of the wraparound-style shipping and reclosable container formed from the blank in FIG. 1 illustrating the manner in which the container can be reclosed.

Referring to FIGS. 2-6, these figures illustrate the wraparound-style shipping and reclosable container 20 in various positions. For example, FIG. 2 illustrates the manner in which the container 20 can be opened by a user or a retailer at the point of sale. Since FIG. 2 shows only one of the two end views of the container 20, then the following description is directed to this one end. However, the other end of the container is exactly the same as the end view shown in FIG. 2 and therefore, the following description equally applies to the other end as one of ordinary skill in the art would appreciate it. The user or retailer pulls out the tuck flap 50*a* so that the tuck flap 50*a* is detached from the glue panel 52*a* via the frangible line 54*a*. The user now has the option to remove some of the products from the container 20 to put on the shelves for sell or display and the remaining products are left in the container 20 so that the shelves can be replenished with the products later on. One of the advantages of the wraparound-style shipping and reclosable container 20 of the present invention is that the container is constructed from one-piece of corrugated paperboard that is easily reclosable by tucking a rear portion of the respective tuck flaps 50*a*, 50*b* to the inside of the container and leaving the front portion of the respective wing flaps 50*a*, 50*b* of to the outside of the container 20. The reclosable aspect of the present invention is now described in greater detail.

Figure 5:
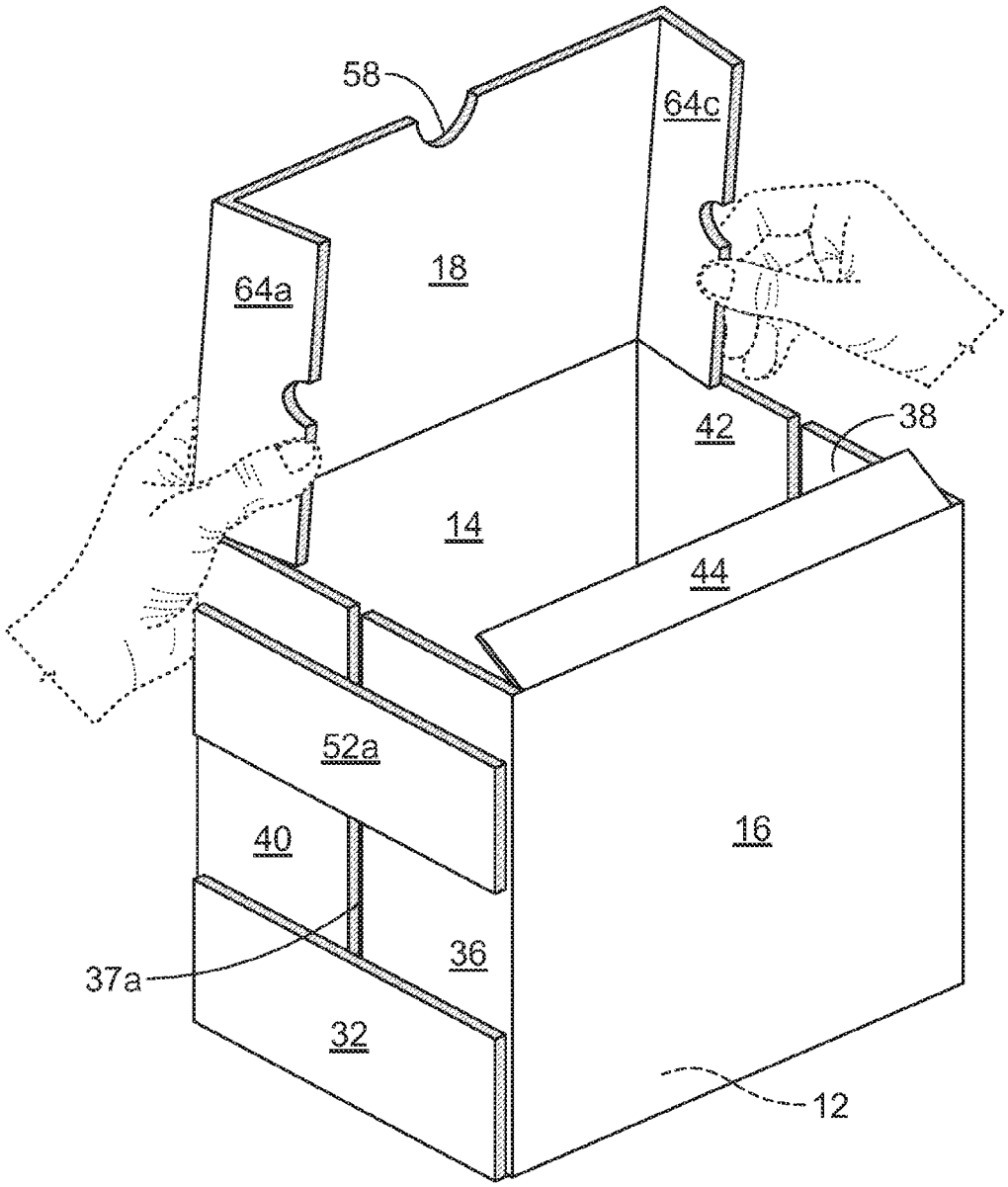
Figure 6:
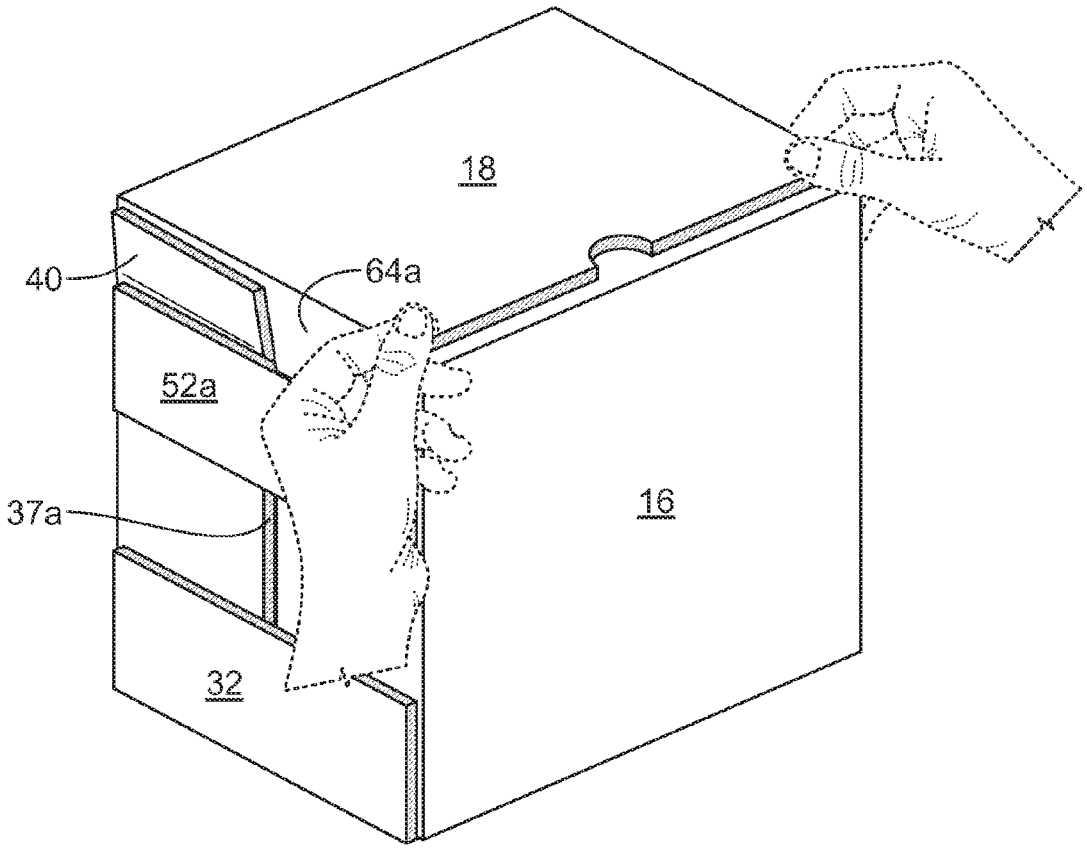
FIG. 6 is a perspective view of the wraparound-style shipping and reclosable container formed from the blank in FIG. 1 illustrating the container in fully reclosed position.

Each of the tuck flaps 50*a*, 50*b* includes a front portion and a rear portion. For example, the tuck flap 50*a* includes a front portion 64*a* and a rear portion 64*b* and the tuck flap 50*b* includes a front portion 64*c* and a rear portion 64*d*. The front portion and a rear portion of each of the tuck flaps 50*a*, 50*b* is limited by the respective finger access holes 56*a*, 56*b*. When the respective tuck flaps 50*a*, 50*b* engages with the respective end wall panels 36, 38 and the respective end wall panels 40, 42, the respective finger access holes 56*a*, 56*b* facilitate this engagement via the respective gap 37*a*, 37*b*. In fact, the respective gap 37*a*, 37*b* forms a slot such that it permits tucking a rear portion 64*b* to the inside of the container and leaving the front portion 64*a* to the outside of the container 20. In use, after the retailer removes some of the products from the container 20 for sell or display, the container 20 can then be enclosed by slightly pressing the rear portion 64*b* inward toward the interior of the container so that the rear portion 64*b* is tucked to the inside of the container and the front portion 64*a* to the outside of the container 20 as illustrated in FIGS. 5 and 6. Stated differently, the rear portion 64*b* is engaged with the inner surface of the end wall panel 40 and is concealed thereto and the front portion 64*a* is engaged with the outer surface of the end wall panel 36 and is exposed therefrom. In this position, the lower edge of the front portion 64*a* sits on the top edge of the glue flap 52*a* which further enhances the manner in which the top cover 18 is supported. To open the container 20, the retailer uses the finger access cutout 58 to pull up the top cover panel 18 to access the products in the container.

Referring back again to FIGS. 2-6, the container 20 includes a bottom wall 12 foldably joined to respective upstanding first and second opposed side walls 14, 16 and to respective glue panels 32, 34. Each of the side walls 14, 16 includes a respective pair of end walls 36, 38 and 40, 42 each of which foldably joined to the respective lateral edges of the respective side walls. The bottom wall 12 including the glue panels 32, 34, upstanding first and second opposed side walls 14, 16, and the end walls 36, 38, 40, 42 all of which foldably joined to one another to form the interior space 62. The glue panel 34 can't be seen in the shown views in FIGS. 2-6, but one of ordinary skill in art appreciate that it is exactly the same as glue panel 32. A top cover panel 18 is foldably joined to the longitudinal edge of the first side wall 14 to enclose container 20. The top cover panel 18 includes two wing flaps 50*a*, 50*b* each of which is foldably joined to the respective lateral edges thereof as seen best in FIG. 3. A shoulder flap 44 is foldably joined to the longitudinal edge of the second side wall 16 to provide support for the top cover wall 18 when the container is enclosed.

In sum, the wraparound-style shipping and reclosable container 20 of the present invention is constructed from one-piece of corrugated paperboard that is easily reclosable by tucking a portion of wing flaps of the cover top wall to the inside of the container and leaving the other portion of the wing flaps of the cover top wall to the outside of the container. In accordance with the teaching of the present invention, an efficient and easily machine-formed container is provided from a one-piece paperboard blank. The invention includes various inventive features which may be used singularly or in combination.

While the preferred embodiment of the invention has been illustrated and described, it will be appreciated that various changes can be made therein without departing from the spirit and scope of the invention. In particular, the drawings and the foregoing descriptions are not intended to represent the only forms of the invention in regard to the details of its construction and manner of operation. Indeed, the inventive aspects taught by the present invention may be practiced alone or in combination. Further, as will be appreciated by those skilled in the art, various modifications are possible in how the various fold lines, etc. are formed. For example, perforations may be used in some instances, while crushes or even cuts are used in others.

What is claimed is:

1. A wraparound-style shipping and reclosable container containing products therein, comprising:

a bottom wall foldably joined to respective upstanding first and second opposed side walls;

a pair of end walls each of which being foldably joined to respective lateral sides of the respective first and second opposed side walls to form an interior space and forming a narrow gap when the pair of end walls being positioned perpendicular to the bottom wall, each of the end walls includes an inner side surface and an outer side surface;

a top cover being foldably joined to a longitudinal edge of the first side wall to enclose the interior space, two wing panels each of which being foldably joined to opposed lateral edges of the top cover panel, each of the two wing panels being defined by a tuck flap and a glue flap both frangiblably attached to one another and wherein at a first position, each of the glue flaps is glued to the respective end walls so as to enclose the container after the products being disposed therein and at a second position, each of the tuck flaps is detached from the respective glue flaps so as to remove products from the container; and each of the tuck flaps includes a front portion and a rear portion that being limited by a finger access hole wherein the finger access hole engages with the narrow gap when the container is reclosed by tucking the rear portion of the respective tuck flaps to the inner side surface of the respective end walls and leaving the front portion of the respective tuck flaps to the outer side surface of the respective end walls.

2. The container of claim 1 wherein the bottom wall has a width that is longer than a combined width of the pair of end wall oriented perpendicular to the bottom wall so as to form a gap or a slot.

3. The container of claim 2 further comprising a shoulder flap foldably joined to a longitudinal side of the second side wall that is used to support the top cover when the container is enclosed.

4. A wraparound-style shipping and reclosable container formed from a one-piece blank, the container comprising:

a bottom wall foldably joined to respective upstanding first and second opposed side walls, the bottom wall includes two glue panels each of which foldable extends from opposed lateral edges thereof;

a pair of end walls each of which being foldably joined to respective lateral sides of the respective first and second opposed side walls to form an interior space when each of the glue panels being attached to the respective end walls and wherein a combined widths of the pair of end walls is less than a width of the bottom wall so that a slot or a narrow gap is formed therein; and a top cover foldably joined to a longitudinal edge of the first side wall to enclose the interior space, the top cover includes two wing panels each of which being defined by a tuck flap and a glue flap that are attached to one another by a frangible line of weakness, the tuck flap includes a front portion and a rear portion which is used to engage with the slot to reclose the container by tucking the rear portion of the respective tuck flaps to inside of the interior space and leaving the front portion of the respective tuck flaps to outside of the interior space.

5. The container of claim 4 wherein the glue flap is used to further support the tuck flap when the container is enclosed.

* * * * *